US005373877A

United States Patent [19]

Chapman

[11] Patent Number: 5,373,877

[45] Date of Patent: Dec. 20, 1994

[54] LOG SPLITTER

[76] Inventor: Fredrick A. Chapman, R.R. 1, Spectacle Pond Rd., Kezar Falls, Me. 04047

[21] Appl. No.: 199,421

[22] Filed: Feb. 22, 1994

[51] Int. Cl.[5] ..... B27L 7/00

[52] U.S. Cl. ..... 144/193 A; 144/193 R; 144/366

[58] Field of Search ..... 144/193 R, 193 A, 193 D, 144/193 E, 366

[56] References Cited

U.S. PATENT DOCUMENTS

| | | | |
|---|---|---|---|
| 846,838 | 3/1907 | Zannon | 144/193 A |
| 1,020,072 | 3/1912 | Barnhart | 144/193 A |
| 3,077,214 | 2/1963 | Brukner | 144/193 A |
| 3,242,955 | 3/1966 | Hellstrom | 144/193 A |
| 4,266,585 | 5/1981 | Denzer | 144/193 A |
| 4,431,362 | 2/1984 | Wech, Jr. et al. . | |
| 4,478,263 | 10/1984 | Johnston . | |
| 4,544,008 | 10/1985 | Reini . | |
| 4,842,030 | 6/1989 | Meyer . | |

*Primary Examiner*—W. Donald Bray
*Attorney, Agent, or Firm*—Rhodes & Ascolillo

[57] ABSTRACT

A log splitter having a log splitting station positioned between a log retaining plate and a hydraulic cylinder, both mounted upon an elongated frame, is disclosed. In use, the hydraulic cylinder, having a reciprocating piston rod to which a log splitting wedge is attached, pushes the wedge against a log positioned in the splitting station. A pump secured to the frame supplies pressurized hydraulic fluid to the hydraulic cylinder for movement of the piston rod. A valve, in fluid communication with the pump, regulates the flow of hydraulic fluid to the hydraulic cylinder. A knee pedal, positioned adjacent the log splitting station and associatively linked with the valve, selectively controls the hydraulic system and the motion of the reciprocating piston rod.

7 Claims, 4 Drawing Sheets

LOG SPLITTER

BACKGROUND OF THE INVENTION

1. Field of the Invention

The present invention relates generally to wood processing machines and is particularly directed to a device employing a hydraulically driven wedge for splitting logs into multiple pieces suitable for use as firewood.

2. Description of the Related Art

Numerous devices employing hydraulically powered cylinders for splitting logs have been proposed in the past. Many of these include means for automatically lifting the log to the splitter. For instance, U.S. Pat. No. 4,544,008, issued Oct. 1, 1985 to Donald N. Reini, provides a log supporting frame pivotally connected to a log splitting machine for this purpose. The frame may be raised by a hydraulic cylinder to roll a log to the splitting station. As the average non-commercial operator splits logs of small size, this lifting feature has not been found to be of particular benefit.

U.S. Pat. No. 4,842,030, issued Jun. 27, 1989 to John P. Meyer, discloses improvements in log splitting devices including an improved log-lifting table having multiple attachment points and greater upward radial movement. It includes a multiple faceted splitting wedge having a cutting angle of less than 90 degrees and a splitting angle of greater than 90 degrees.

U.S. Pat. No. 4,431,362, issued Feb. 14, 1984 to Malcolm H. Wech, Jr. et al., discloses an apparatus for lifting logs from ground level to a bed of a log splitting machine which includes at least two arms forming a loading rack for the logs and a pivotally mounted lifting arm assembly which is selectively engaged and operated by rearward motion of a slideably mounted sled.

U.S. Pat. No. 4,478,263, issued Oct. 23, 1984 to James L. Johnston, discloses a wood processing machine used for processing logs into specific lengths and then splitting those lengths into individual pieces used for firewood. The individual pieces are retained in a unit bin until a desired quantity has been processed.

It has been found that, for proper splitting, many logs require manual adjustments of position after being rolled into the station. As the control handle for the splitter is usually remote from the splitting station, two individuals are usually required to efficiently split wood with such a device. A need, therefore, exists for a wood splitter whose hydraulic features can be operated by a single operator while simultaneously allowing the free use of his hands for positioning wood within the splitting station.

SUMMARY OF THE INVENTION

Accordingly, it is a principal object of the present invention to provide a log splitter with a knee pedal positioned adjacent the log splitting station and associatively linked with the control valve of the splitter's hydraulic cylinder for selectively controlling the motion of the cylinder's reciprocating piston rod and its attached log splitting wedge.

Another object of the present invention is to provide a log splitter of the type described wherein the knee pedal is pivotally secured to the log retaining plate forming part of the splitting station.

It is a further object of the invention to provide improved elements and arrangements thereof in a log splitter for the purposes described which is inexpensive, dependable and fully effective in accomplishing its intended purposes.

The present invention achieves the above objects, among others, by providing, in one aspect, a log splitter. The log splitter includes a hydraulic cylinder mounted upon an elongated frame, with the cylinder having a reciprocating piston rod. A log splitting wedge is secured to the reciprocating piston rod, and a log retaining plate is joined to the frame in an opposing relationship to the log splitting wedge so as to define a log splitting station therebetween. There is a pump secured to the frame for supplying pressurized hydraulic fluid to the hydraulic cylinder, with a valve in fluid communication with the pump for regulating the flow of hydraulic fluid to the hydraulic cylinder. Finally, a knee pedal is positioned adjacent the log splitting station and associatively linked with the valve for selectively controlling the motion of the reciprocating piston rod; the knee pedal is also pivotally secured to the log retaining plate.

Preferably, the log splitter further includes a horizontal shaft having a forward and a rearward end, with the rearward end being connected to the knee pedal. A control handle extends upwardly from the valve, and a moment arm is joined to the upper end of the control handle and extends normally therefrom. There is a pulley rotationally joined to the frame, with the pulley engaging the forward end of the horizontal shaft for fitting the motion of the shaft in a substantially horizontal plane. Additionally, a flexible cable is suspended from the moment arm, with a lower end of the cable connected to the forward end of the horizontal shaft. This flexible cable is positioned about the pulley and biases the horizontal shaft upwards against the pulley.

A first coiled spring is connected to the control handle for normally retaining the control handle in an upright orientation and biasing the flexible cable upward through the moment arm, and a second coiled spring joins the forward end of the rigid shaft and the frame, thus retaining the shaft in a horizontal orientation throughout its entire range of motion. The valve is selectively actuated by movement of the knee pedal, which imparts a rotational movement to the control handle through the cooperative action of the shaft, cable, and moment arm.

Preferably, the log splitter further includes a longitudinally movable rod secured by a close-fitting sleeve to the top of the hydraulic cylinder, which is positioned between the valve and the rear edge of the log splitting wedge for halting the movement of the piston rod prior to its complete retraction into the hydraulic cylinder by engaging the valve and sharing the flow of hydraulic fluid to the hydraulic cylinder when contacted by the wedge.

The longitudinally movable rod includes a plurality of nested rod segments, with at least one of the plurality of rod segments having a series of laterally spaced bores along its length, adapted to receive a pin for adjustably fixing the length of the longitudinally movable rod.

In another aspect, the invention generally features a log splitter, including an elongated flame and a hydraulic cylinder mounted upon the frame and having a reciprocating piston rod. A log splitting wedge is secured to the reciprocating piston rod, and a log retaining plate is joined to the frame in an opposing relationship to the log splitting wedge so as to define a log splitting station therebetween. There is a hydraulic control system, in fluid communication with the hydraulic cylinder, including a valve for selectively controlling the motion of the reciprocating piston rod. A knee pedal is pivotally secured to the log retaining plate and associatively linked with the valve. Finally, a longitudinally movable rod is secured by a close-fitting sleeve to the top of the hydraulic cylinder and positioned between the valve and the log splitting wedge for halting the movement of the piston rod prior to its complete retraction into the hydraulic cylinder by engaging the valve and abating the flow of hydraulic fluid to the hydraulic cylinder when contacted by a rear edge of the log splitting wedge.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
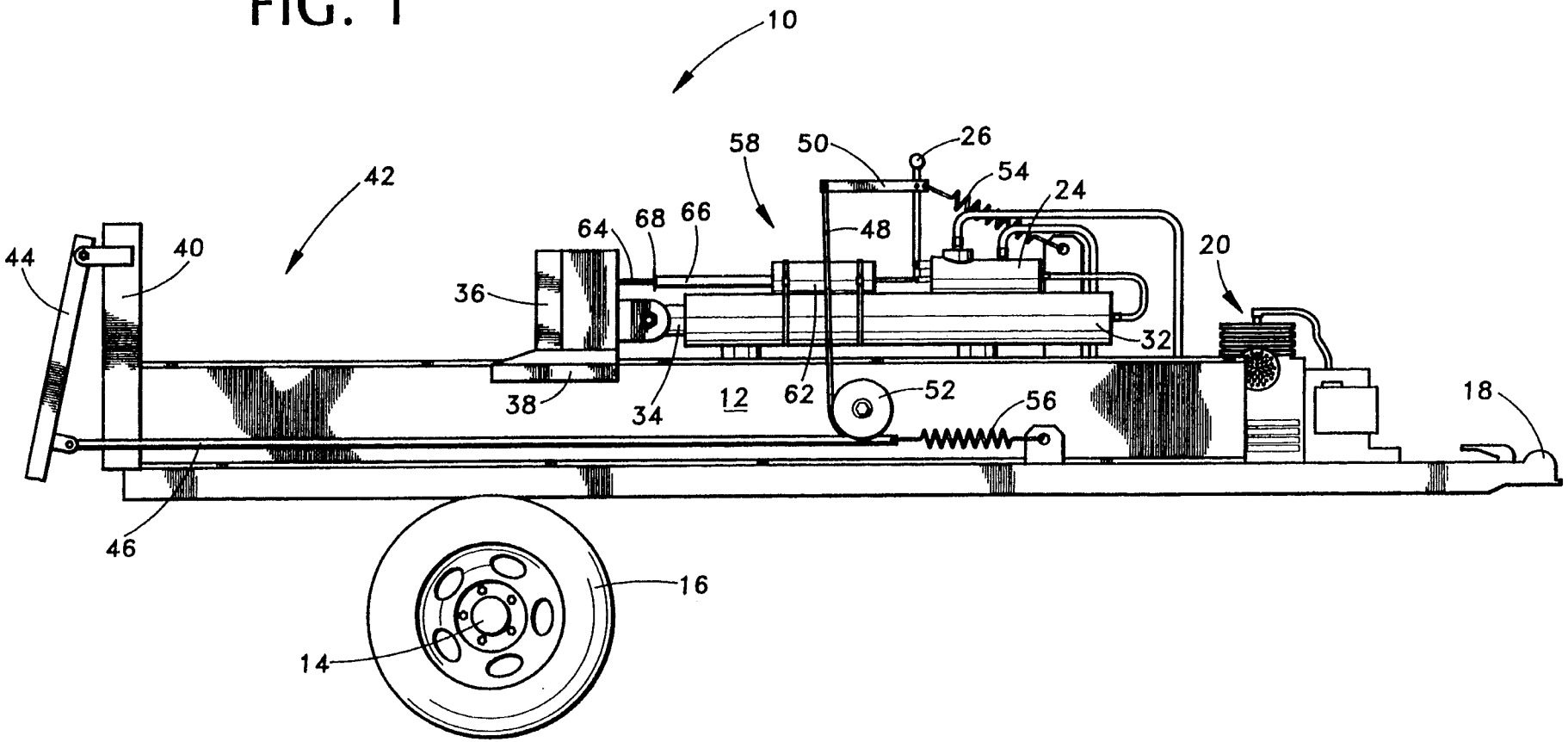
FIG. 1 is a side elevational view of a log splitter in accordance with the present invention.

Referring now to the figures, a log splitter in accordance with the present invention is illustrated. The log splitter 10 includes an elongated frame 12 preferably in the form of an I-beam. Connected to the rearward end of the frame 12 is an axle 14 for mounting a pair of wheels 16 laterally from the frame. The axle 14 may be mounted to the frame 12 by braces (not shown). In some embodiments of the log splitter 10, the axle 14 is a cylinder used to store hydraulic fluid, available through piping, to the hydraulic pump. To provide ready transportability to the log splitter 10, the forward end of the frame 12 may be provided with a well-known trailer hitch 18.

The forward end of the frame 12 is utilized to securely support a prime mover, such as internal combustion engine 20. The crankshaft of the engine 20 is adapted to drive, in a well known manner, a hydraulic pump 22 which has been secured to the frame. The pump 22 is not seen in FIG. 1 but, rather, is indicated in the schematic diagram of FIG. 2. The flow of hydraulic fluid from the pump 22 is controlled by a three-way valve 24 through a manually operated control handle 26 extending upwardly from the valve 24. The outlet ports of valve 24 are connected by lines 28 and 30 to opposite ends of a standard hydraulic cylinder 32 which is mounted longitudinally upon the frame 12.

Figure 3:
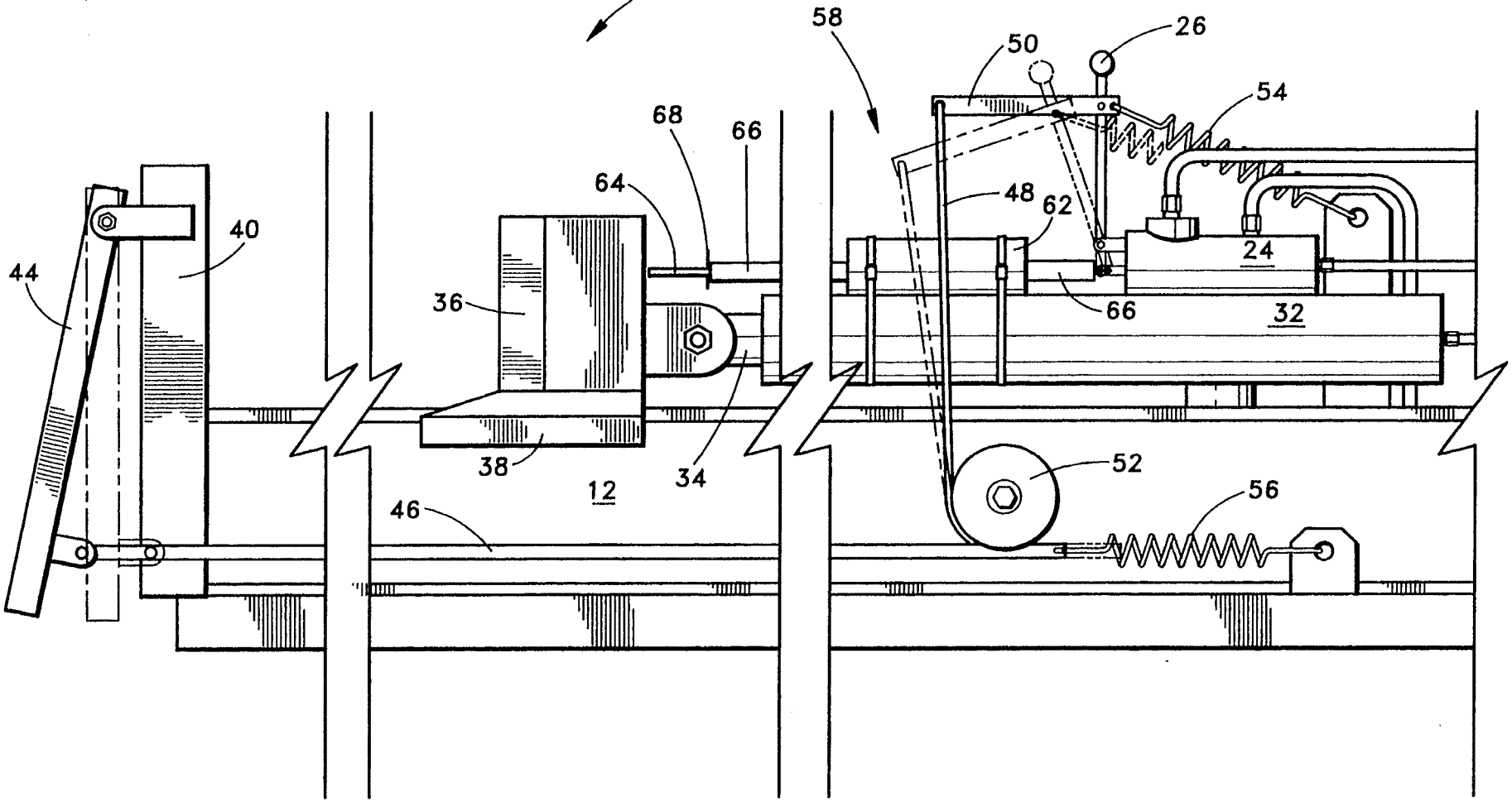
FIG. 3 is a partial side elevational view of the log splitter of FIG. 1, with movement of the knee pedal and connected control features shown in broken lines.

Extending from the cylinder 32 is a reciprocating piston rod 34, to the end of which is attached a sharpened log splitting wedge 36. As seen in FIGS. 1 and 3, the wedge 36 is directed in its movement along the frame 12 by a pair of downwardly extending guides 38 which freely ride upon the opposing sides of the frame 12. A log retaining plate 40 is mounted to the rearwardmost end of frame 12 in an opposing relationship to the log splitting wedge 36 so as to provide a splitting station 42 therebetween.

Pivotally secured to the log retaining plate 40 is a padded knee pedal 44 for moving the control handle 26 from a location remote therefrom. A rigid shaft 46, extending horizontally forward from the bottom of the pedal 44, is connected at its forward end with a substantially vertical cable 48 which, in turn, is suspended from a moment arm 50 extending normally from the upper end of the control handle 26. A pulley 52 rotationally joined to frame 12 is provided at the junction between the shaft 46 and the cable 48 upon which the upper surface of the shaft 46 may ride. The pulley 52 biases the shaft 46 downward against upward forces imparted by the flexible cable 48 thereby retaining the shaft in a horizontal orientation. A coiled spring 54, angularly connecting the upper end of the handle 26 with the frame 12, biases any downward force applied to the moment arm 50 as, for example, would be generated by depressing the knee pedal 44 and normally retains the control handle in an upright orientation. A second coiled spring 56 joins the forward end of the shaft 46 with the frame 12 and retains the shaft in a horizontal orientation throughout its entire range of longitudinal motion.

The operation of the log splitter 10 is best described in terms of a complete log splitting cycle. Initially, it will be assumed that the operator has previously positioned the handle 26 to displace the spool of valve 24 to the right with respect to FIG. 2. At this point, the piston rod 34 is in the most extended position and has finished splitting a log. To begin the splitting cycle, the operator releases any pressure which he may be exerting on the knee pedal 44 such that the valve spool is displaced to the left in FIG. 2 by the light force provided by spring 54 on control handle 54. The valve 24 then directs pressurized hydraulic fluid through the line 28 to the hydraulic cylinder 32 so as to retract the piston rod 34 and attached wedge 36. When the wedge 36 is retracted, the operator may manually position a log in the splitting station 42 atop the frame 12 and between the wedge 36 and the plate 40. To prevent a log having an odd shape from moving laterally from the narrow splitting station 42, it is sometimes necessary to stabilize such with a light amount of manual pressure by the operator.

After piston rod 34 is fully retracted and the log is in place in splitting station 34, the log may be split. For that purpose, the operator reverses the control handle 26 by pushing the knee pedal 44 forward to the position shown in broken lines in FIG. 3. Thus, the valve spool would be shifted to the right in FIG. 2. The pressurized hydraulic fluid delivered from the pump 22 then flows through the line 30 to extend the piston rod 34 and wedge 36, thereby forcing the wedge against the log for splitting.

To reduce the amount of time involved in splitting logs having a short length, a stop mechanism indicated generally at 58, is provided for halting the movement of the piston rod 34 prior to its complete retraction into the cylinder 32. The mechanism includes a longitudinally movable rod comprising two nested rod segments 64 and 66. The narrower segment 64 is provided with a series of laterally spaced bores, shown as short dashes G7 in FIG. 4, along its length for receiving a pin 65. The pin 68 may be selectively inserted and retained within any of the bores so as to adjust the overall length of the rod by preventing the continued movement of segment 64 into the rear edge of segment 66. The rod is secured by a close-fitting sleeve 62 to the top of the cylinder 32 and between the valve 24 and the wedge 36.

Figure 2:
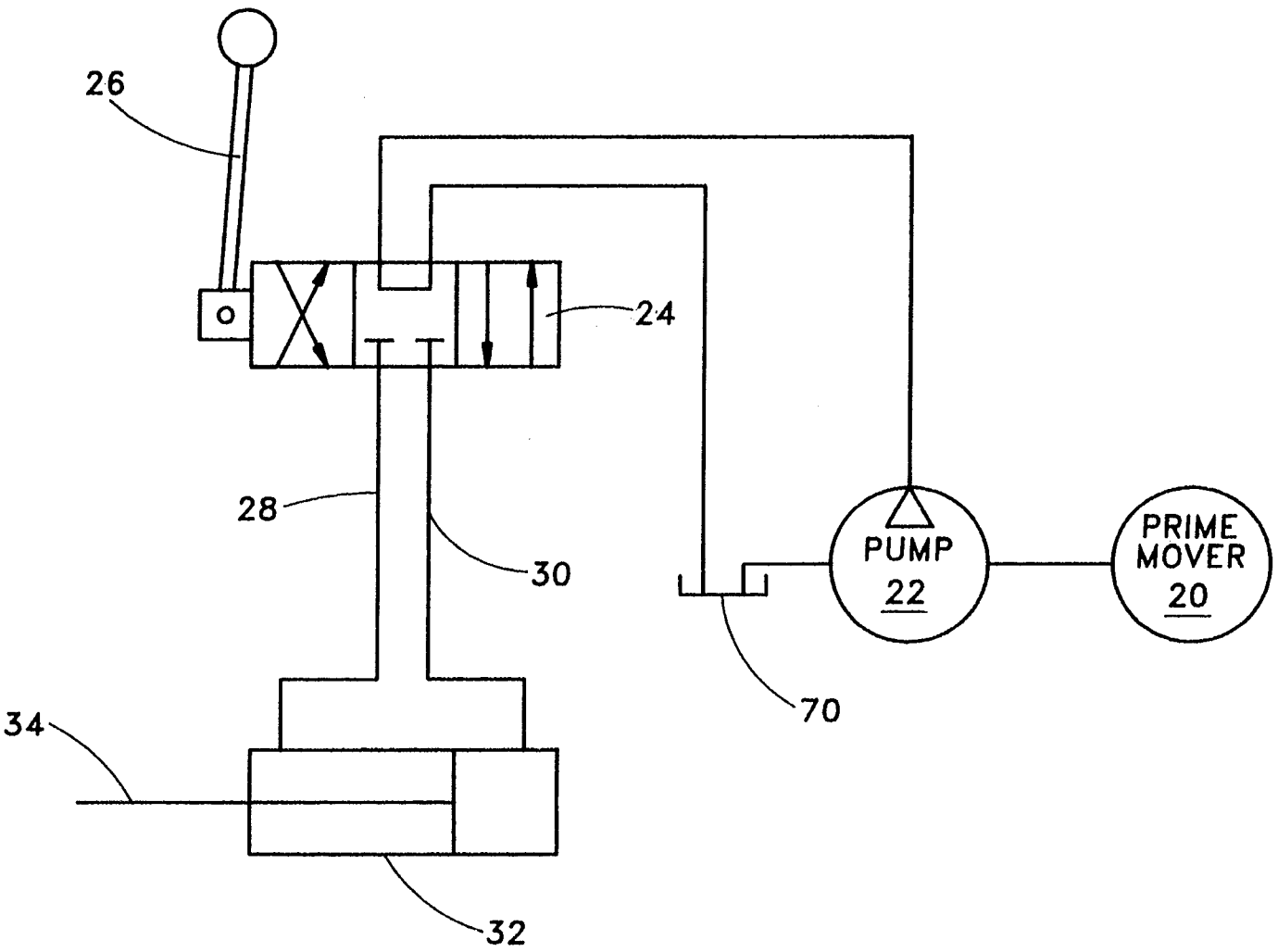
FIG. 2 is a schematic diagram of the hydraulic system of the log splitter.
Figure 4:
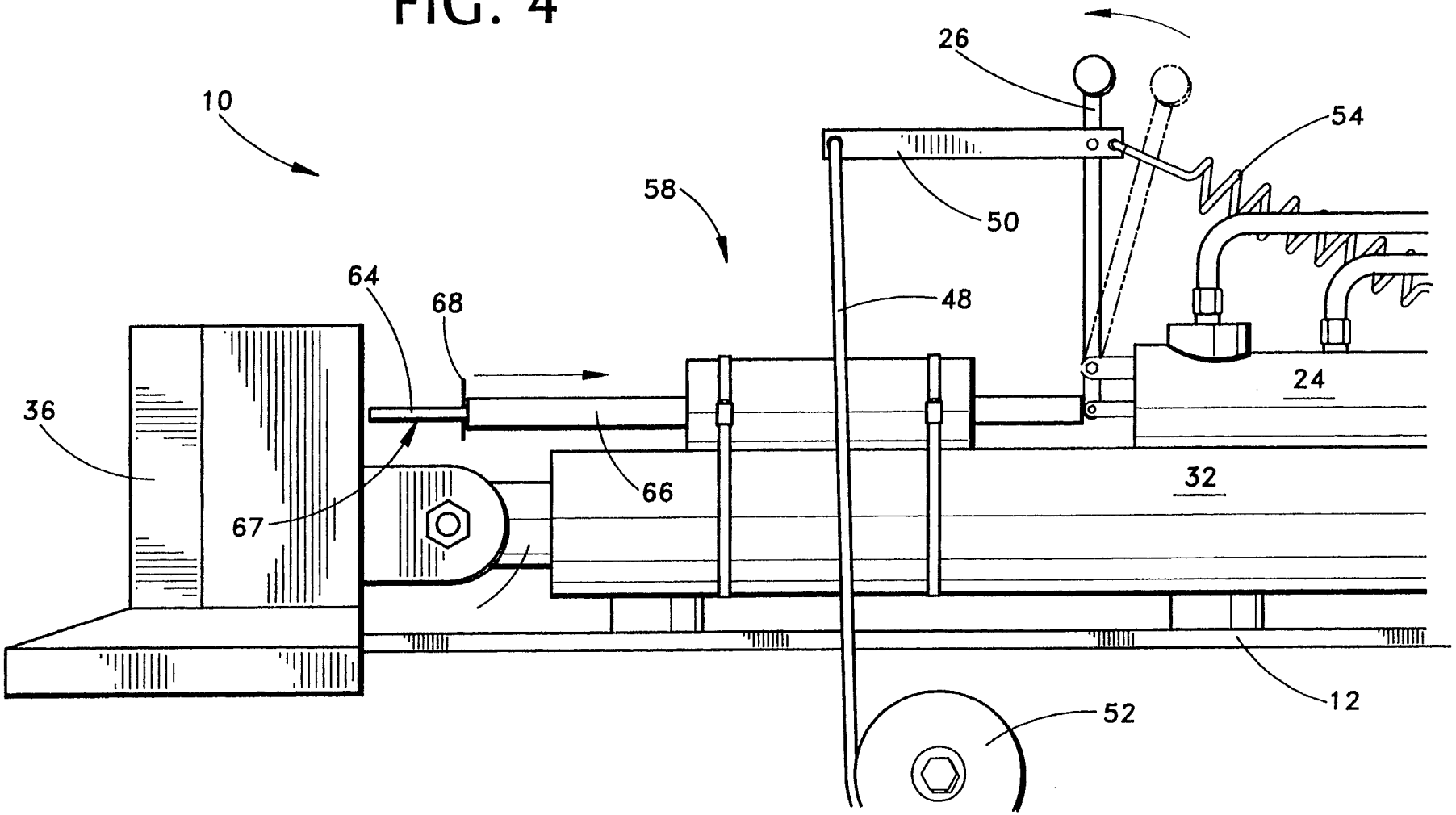
FIG. 4 is a partial side elevational view of the log splitter enlarged to show details of the stop mechanism for the hydraulic cylinder.

As the wedge 36 is being retracted during use, it will eventually contact the rearward end of the rod segment 64 moving such forward as indicated by the arrow in FIG. 4. As the rod is substantially rigid, the forward end of rod segment 66 is driven into contact with the valve spool 24. The valve spool, in turn, is moved to the right, as shown in FIG. 2, and into its "neutral" or central position whereby hydraulic fluid is prevented from passing from the pump 22 to the cylinder 32. In this position, the valve spool 24 circulates fluid between the pump 22 and the fluid reservoir 70, performing no useful work. The wedge 36 is thus prevented from further retraction and time consuming motion. Of course, later extension of the wedge 36 may be accomplished in the manner described above and the log splitting cycle repeated as often as is required for completion of the log splitting chores.

It is to be understood that the present invention may be embodied in other specific forms and is not limited to the sole embodiment described above, but encompasses any and all embodiments within the spirit and scope of the following claims. Therefore, the present embodiment must be considered in all respects as illustrative only.

I claim:

1. A log splitter, comprising:

an elongated frame;

a hydraulic cylinder mounted upon said frame and having a reciprocating piston rod;

a log splitting wedge secured to said reciprocating piston rod;

a log retaining plate joined to said frame in an opposing relationship to said log splitting wedge so as to define a log splitting station therebetween;

a pump secured to said frame for supplying pressurized hydraulic fluid to said hydraulic cylinder;

a valve in fluid communication with said pump for regulating the flow of hydraulic fluid to said hydraulic cylinder; and a knee pedal positioned adjacent said log splitting station and associatively linked with said valve for selectively controlling the motion of said reciprocating piston rod.

2. The log splitter according to claim 1, wherein said knee pedal is pivotally secured to said log retaining plate.

3. The log splitter according to claim 2, further comprising:

a horizontal shaft having a forward and a rearward end, said rearward end being connected to said knee pedal;

a control handle extending upwardly from said valve;

a moment arm joined to the upper end of said control handle and extending normally therefrom;

a pulley rotationally joined to said frame, said pulley engaging said forward end of said horizontal shaft: for guiding the motion of said shaft in a substantially horizontal plane;

a flexible cable suspended from said moment arm, a lower end of said cable connected to said forward end of said horizontal shaft, said flexible cable positioned about said pulley and biasing said horizontal shaft upwards against said pulley;

a first coiled spring connected to said control handle for normally retaining said control handle in an upright orientation and biasing said flexible cable upward through said moment arm; and a second coiled spring joining the forward end of said rigid shaft and said frame, said second coiled spring retaining said shaft in a horizontal orientation throughout its entire range of motion;

whereby said valve is selectively actuated by movement of said knee pedal which imparts a rotational movement to said control handle through the cooperative action of said shaft, cable, and moment arm.

4. The log splitter according to claim 1, further comprising:

a longitudinally movable rod secured by a close-fitting sleeve to the top of said hydraulic cylinder and positioned between said valve and said rear edge of said log splitting wedge for halting the movement of said piston rod prior to its complete retraction into said hydraulic cylinder by engaging said valve and abating the flow of hydraulic fluid to said hydraulic cylinder when contacted by said wedge.

5. The log splitter according to claim 4, wherein said longitudinally movable rod includes a plurality of nested rod segments, at least one of said plurality of rod segments having a series of laterally spaced bores along its length, each adapted to receive a pin for adjustably fixing the length of said longitudinally movable rod.

6. A log splitter, comprising:

an elongated frame;

a hydraulic cylinder mounted upon said frame and having a reciprocating piston rod;

a log splitting wedge secured to said reciprocating piston rod;

a log retaining plate joined to said frame in an opposing relationship to said log splitting wedge so as to define a log splitting station therebetween;

a hydraulic control system, in fluid communication with said hydraulic cylinder, including a valve for selectively controlling the motion of said reciprocating piston rod;

a knee pedal pivotally secured to said log retaining plate and associatively linked with said valve; and a longitudinally movable rod secured by a close-fitting sleeve to the top of said hydraulic cylinder and positioned between said valve and said log splitting wedge for halting the movement of said piston rod prior to its complete retraction into said hydraulic cylinder by engaging said valve and abating the flow of hydraulic fluid to said hydraulic cylinder when contacted by a rear edge of said log splitting wedge.

7. A log splitter comprising:

an elongated frame;

a hydraulic cylinder mounted upon said frame and having a reciprocating piston rod;

a log splitting wedge secured to said reciprocating piston rod;

a log retaining plate joined to said frame in an opposing relationship to said log splitting wedge so as to define a log splitting station therebetween;

a pump secured to said frame for supplying pressurized hydraulic fluid to said hydraulic cylinder;

a valve in fluid communication with said pump for regulating the flow of hydraulic fluid to said hydraulic cylinder;

a knee pedal positioned adjacent said log splitting station and associatively linked with said valve for selectively controlling the motion of said reciprocating piston rod;

said knee pedal is pivotally secured to said log retaining plate; a horizontal shaft having a forward and a rearward end, said rearward end being connected to said knee pedal;

a control handle extending upwardly from said valve;

a moment arm joined to the upper end of said control handle and extending normally therefrom;

a pulley rotationally joined to said frame, said pulley engaging said forward end of said horizontal shaft for guiding the motion of said shaft in a substantially horizontal plane;

a flexible cable suspended from said moment arm;

a lower end of said cable connected to said forward end of said horizontal shaft;

said flexible cable positioned about said pulley and biasing said horizontal shaft upwards against said pulley;

a first coiled spring connected to said control handle for normally retaining said control handle in an upright orientation and biasing said flexible cable upward through said moment arm;

a second coiled spring joining the forward end of said rigid shaft and said frame, said second coiled spring retaining said shaft in a horizontal orientation throughout its entire range of motion;

whereby said valve is selectively actuated by movement of said knee pedal which imparts a rotational movement to said control handle through the cooperative action of said shaft, cable, and moment arm;

a longitudinally movable rod secured by a close-fitting sleeve to the top of said hydraulic cylinder and positioned between said valve and said rear edge of said log splitting wedge for halting the movement of said piston rod prior to its complete retraction into said hydraulic cylinder by engaging said valve and abating the flow of hydraulic fluid to said hydraulic cylinder when contacted by said wedge; and said longitudinally movable rod includes a plurality of nested rod segments, at least one of said plurality of rod segments having a series of laterally spaced bores along its length, each adapted to receive a pin for adjustably fixing the length of said longitudinally movable rod.

* * * * *